US007631751B2

(12) United States Patent
Bubits et al.

(10) Patent No.: US 7,631,751 B2
(45) Date of Patent: Dec. 15, 2009

(54) CARTRIDGE MAGAZINE FOR A HANDGUN AND PROTECTIVE DEVICE FOR CARTRIDGE MAGAZINES

(76) Inventors: Wilheim Bubits, Franz-Anderle-Platz, 3/4/6, A-2345, Brunn/Gebirge (AT); Günther Eder, Wagramerstrasse 23/1/51, A-1220, Vienna (AT)

( * ) Notice: Subject to any disclaimer, the term of this patent is extended or adjusted under 35 U.S.C. 154(b) by 0 days.

(21) Appl. No.: 11/916,967

(22) PCT Filed: Jun. 13, 2006

(86) PCT No.: PCT/AT2006/000238

§ 371 (c)(1),
(2), (4) Date: Dec. 7, 2007

(87) PCT Pub. No.: WO2006/133470

PCT Pub. Date: Dec. 21, 2006

(65) Prior Publication Data

US 2008/0196290 A1 Aug. 21, 2008

(30) Foreign Application Priority Data

Jun. 13, 2005 (AT) ..... GM390/2005

(51) Int. Cl.
*F42B 39/26* (2006.01)

(52) U.S. Cl. ..... 206/3; 89/34

(58) Field of Classification Search ..... 89/34; 206/3, 317

See application file for complete search history.

(56) References Cited

U.S. PATENT DOCUMENTS

| | | | | |
|---|---|---|---|---|
| 3,087,270 | A * | 4/1963 | Stoner | 42/50 |
| 3,603,020 | A | 9/1971 | Wiese | |
| 4,442,962 | A | 4/1984 | Musgrave | |
| 4,815,822 | A * | 3/1989 | Bramhall | 359/601 |
| 5,152,442 | A | 10/1992 | Gallagher | |
| 5,174,482 | A | 12/1992 | Rogers et al. | |
| 5,319,872 | A * | 6/1994 | Bammate | 42/88 |
| 5,440,774 | A * | 8/1995 | Cole | 15/105 |
| 6,631,801 | B2 * | 10/2003 | Boyd-Moss et al. | 206/204 |

OTHER PUBLICATIONS

"Rifle Stand Bipods Featherweight AR-15 SKS Studmount"; XP-002395226, internet article, (Feb. 4, 2003), http://www.profilon.us/atbipod.htm; whole document, 6 p.

AR-15/M16 Magazine Dust Cover:, XP-002395227, Allen's Law Enforcement Safety Products, internet article, (Jun. 8, 2002), http://www.bushmaser.com/shopping/magazine;ati15223.asp (retrieved Aug. 18, 2006) 1 p.

* cited by examiner

*Primary Examiner*—Stephen M Johnson
(74) *Attorney, Agent, or Firm*—Greer, Burns & Crain, Ltd.

(57) ABSTRACT

A cartridge magazines for a handgun, which magazine includes a closed or closable bottom at its lower end and an opening at its upper end, from which one cartridge each is supplied to the handgun, is at least largely surrounded by a single-part, elastic and removable sheath to protect it against soiling and against sand. The sheath is bag-shaped and is slipped over the cartridge magazine upside down so that the rim of the sheath will contact the region of the bottom of the cartridge magazine.

11 Claims, 1 Drawing Sheet

CARTRIDGE MAGAZINE FOR A HANDGUN AND PROTECTIVE DEVICE FOR CARTRIDGE MAGAZINES

The invention relates to a cartridge magazine for a handgun, which magazine comprises a closed or closable bottom at its lower end and an opening at its upper end from which one cartridge each is supplied to the handgun.

Furthermore, the invention relates to a protective device for a cartridge magazine, which protective device is designed as a single-part, elastic sheath surrounding at least a major portion of the cartridge magazine and being removable therefrom; the invention thus can be used for cartridge magazines of conventional construction.

In practice, it has shown that cartridge magazines, irrespective of whether they project outwards from automatic pistols or whether they are arranged in the interior of a rifle or of a pistol grip, repeatedly fail due to dirt, sand or mud, and cause failing of the weapon itself, respectively. Small amounts of dirt in the interior of the weapon or even just in the interior of the magazine are sufficient to cause wedging of the cartridges on the magazine and, thus, a feed jam.

The afore-mentioned soiling exists either externally on the magazine, or it penetrates into the interior of the magazine through the opening on the upper side thereof which, on account of its function, necessarily is narrowed. Some magazines also have larger openings (e.g. for a magazine retainer to snap in) through which dirt may penetrate. In field duty, the penetration of dirt in ammunition bags in which the further cartridge magazines are taken along, cannot be avoided.

From EP 137 068 A1 it is known to close the upper opening of a cartridge magazine with a tear-off strap. This, however, requires a special design of the upper opening of the cartridge magazine and, thus, also of the corresponding parts of the pistol cooperating with the magazine. The very high expenditures for a safety measure which under simple conditions often is not even utilized is extremely uneconomical.

Therefore, it is an object of the invention to avoid the aforementioned malfunction by a suitable design or furnishing of the cartridge magazine and to thereby ensure minimum expenditures for the functional safety even under extreme conditions (e.g. in sandy desert areas). In particular, it shall be possible to safely prevent the penetration of dirt in general, i.e. not only in the region of the upper magazine opening.

According to the invention, this is achieved in a cartridge magazine as initially defined in that the cartridge magazine is at least largely surrounded by a protective device in the form of a single-part, elastic and removable sheath. Thus, the further cartridge magazines can be equipped with such sheaths when the magazines are being filled, which sheath will both protect the exterior of the cartridge magazine against dirt and also prevent dirt from penetrating into the interior of the magazine. Since the sheath is elastic, it will be easy to put it on and also easy to take it off again immediately before the magazine is introduced into the weapon.

Preferably, the bag-shaped sheath is slipped over the cartridge magazine upside down so that the rim of the sheath will contact the region of the bottom of the cartridge magazine. The closed bottom of the sheath thus comes to lie at first over the exposed upper opening of the cartridge magazine, and then the sheath is slipped or rolled over the magazine (preferably over the entire length thereof). When the sheath surrounds the cartridge magazine over its entire length, it is advantageous if the sheath has a reinforced bead at its rim, which bead will then ensure that the sheath will somewhat contract below the bottom of the cartridge magazine.

Preferably, the sheath is a thin-walled, expandable, injection-molded plastics part. Thus, application and removal thereof will be particularly simple and rapid to do. Due to its slight wall thickness, in many instances of use it will not even be necessary to remove the sheath before introducing it into the magazine. The cartridge magazine will simply be inserted into the weapon with its sheath thereon. The breech moving forwardly for loading the uppermost cartridge will tear the sheath open. If the sheath is transparent or translucent, it will be recognizable at any time whether or not the cartridge magazine is completely filled.

A single size of a thin-walled and highly elastic sheath will fit over many different cartridge magazines. It is, however, also possible to make the sheath somewhat stronger and adapt it to a certain cartridge magazine.

The subject matter of the invention is not only a cartridge magazine with such a protective device, but also the protective device itself which has the characteristic features of the invention and, in particular, is formed by a single-part, elastic sheath capable of surrounding at least a major part of the magazine and which optionally can also be removed from the magazine.

In the following, the invention will be explained in more detail by way of preferred exemplary embodiments illustrated in the drawings. In the drawings, in detail, FIG. 1 shows a schematic view of a pistol with a cartridge magazine suitable for applying the invention;

Figure 1:
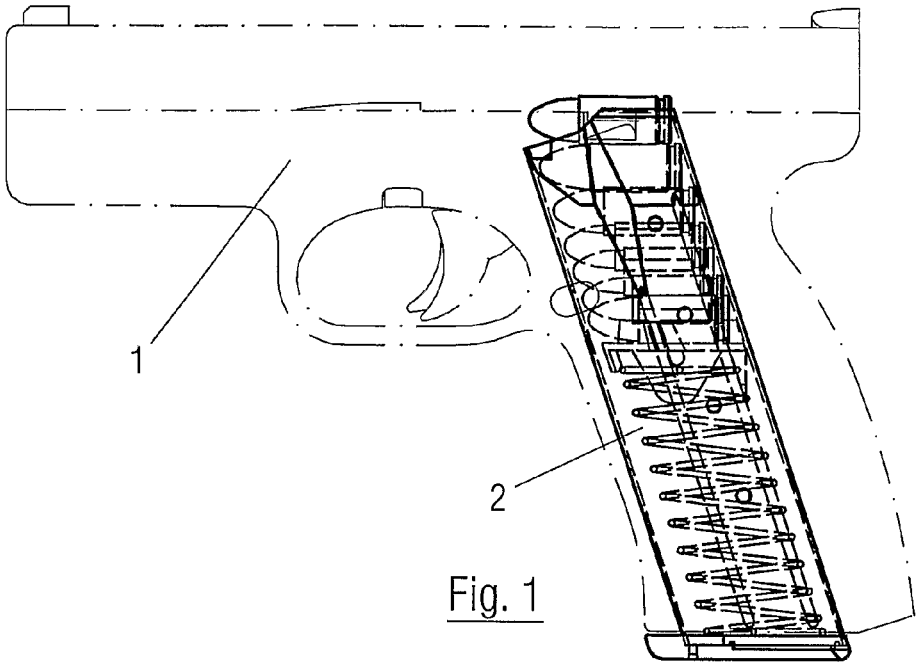

In FIG. 1, a pistol 1 is indicated in broken lines. In its grip, a cartridge magazine 2, termed magazine in short hereinafter, is seated. A magazine 2 of the same type is kept ready by the shooter—e.g. in an ammunition bag not illustrated. The magazine 2 per se is designed according to the prior art and is illustrated by itself in FIG. 2.

Figure 2:
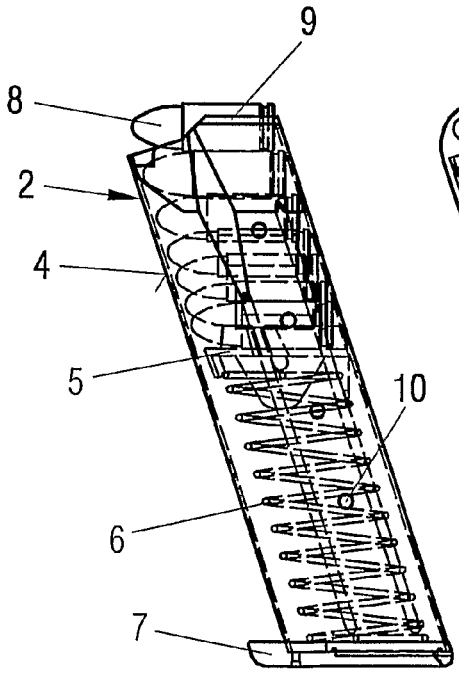
FIG. 2 shows the cartridge magazine according to FIG. 1 externally of the pistol.

According to FIG. 2, the magazine 2 has a body 4 of approximately rectangular cross-section, a magazine bottom 7 at least partially extending to beyond this body, a cartridge delivering member 5 and a magazine spring 6 which is supported on the magazine bottom 7, on the one hand, and on the delivering member 5, on the other hand. The delivering member 5 presses the cartridges 8, which are stacked in the magazine 2 in offset manner, upwards to a narrowed opening 9 through which the forward-moving breech (not illustrated) of the pistol 1 loads the uppermost cartridge 8 into the pistol 1. Dust, sand and the like dirt can enter the interior of the cartridge magazine 2 through this upper opening 9 and through lateral openings 10 occasionally provided.

Figure 3:
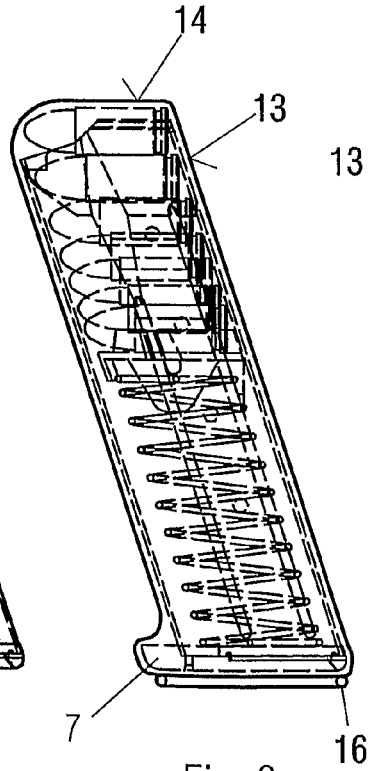
FIG. 3 shows the cartridge magazine according to the invention with the protective device.
Figure 4:
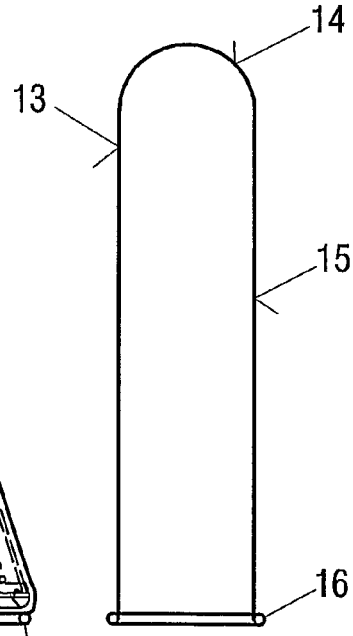
FIG. 4 shows the protective device according to the invention by itself.

In FIG. 3, the furnishing of the cartridge magazine 2 with the inventive protective device can be seen. To protect against penetrating sand etc. and also against external soiling, the cartridge magazine 2 is provided with a sheath 13 already when filling the magazine, or even earlier. In the exemplary embodiment illustrated, this sheath 13 is designed to be bag-like and more or less elastic. The sheath 13 has a bottom 14, a consecutive wall 15 and a reinforced rim 16 which forms a bead (cf. FIG. 4). The cross-section of the wall 15 can be adapted to the cross-section of the cartridge magazine 2, or it may be circular, oval or approximately rectangular. In the first instance, the sheath 13 may be less elastic, and it may be made of plastics or also of metal. Preferably, however, it is an injection-molded plastics part.

In the embodiment illustrated, the sheath 13 is made in a single piece and of a highly elastic, yet nevertheless comparatively tear-resistant material, e.g. latex, and it has a circular or oval cross-section. Here, the sheath is applied to the magazine 2 such that at first its bottom 14 covers the opening 9, and then its wall 15 is pulled or rolled over the body 4 of the magazine 2.

When removing the sheath 13 before introducing the magazine 2 into the pistol 1, this particularly exposed part of the cartridge magazine 2 (i.e., its opening 9) will be the last to be exposed. The lower part of the wall 15 embraces the magazine bottom 7 and, below the latter, it is contracted by the reinforced bead 16 formed at the rim of the sheath 13 to an extent that it will be firmly seated. Thus, it cannot happen that the sheath 13 will unintentionally become detached from the cartridge magazine 2 already when pulling the latter out of the ammunition bag. The bead 16 will also increase the useful life so that, if handled carefully, the sheath 13 can be re-used several times.

If the material of the sheath 13 is particularly thin, it need not even be removed before the magazine 2 is introduced into the pistol 1. The magazine 2 will be pushed into the pistol 1 together with its sheath 13; the breech of the pistol 1 which moves forwards (in shooting direction) for loading the uppermost cartridge 8 will not be impeded by the thin sheath 13, and it will simply tear open its bottom 14 when pushing out the cartridge 8. However, a sheath 13 damaged in this manner cannot be re-used, something that is very well possible when using the variant according to which the sheath 13 is taken off before the magazine 2 is arranged in the pistol 1.

The invention claimed is:

1. A cartridge magazine for a hand gun comprising:

a body having a closed or closable bottom at its lower end and an opening at its upper end, from which one cartridge each can be supplied to the hand gun, and a single-part, elastic, removable sheath having a first end and an opposing second end, that is slipped upside down over the body, the first end of the sheath being a closed end that tears upon insertion into the hand gun, the sheath including a rim at the second end and being configured to surround the body so that the rim contacts the bottom of the body of the cartridge magazine in an operating position, the sheath having a reinforced bead at its rim.

2. The cartridge magazine according to claim 1, wherein the sheath is a thin-walled, expandable, injection-molded plastics part.

3. The cartridge magazine according to claim 1, wherein the sheath is made of latex.

4. The cartridge magazine according to claim 1, wherein the sheath is transparent.

5. The cartridge magazine according to claim 1, wherein the sheath is a device fitting a certain cartridge magazine.

6. The cartridge magazine according to claim 1, wherein the sheath is translucent.

7. A protective device for cartridge magazines comprising:

a single part, elastic sheath adapted to be slipped over one of the cartridge magazines and removable from the magazine, the sheath including a first end and an opposing second end, the first end of the sheath being a closed end that tears upon insertion into the hand gun, the second end of the sheath including a rim having a bead, the bead being adapted to contact a bottom end of the cartridge magazine in an operating position.

8. The protective device according to claim 7, wherein the sheath is an expandable injection-molded plastics part.

9. The protective device according to claim 7, wherein the sheath is made of latex.

10. The protective device according to claim 7, wherein the sheath is transparent.

11. The cartridge magazine according to claim 7, wherein the sheath is translucent.

* * * * *